US007182706B2

(12) United States Patent
Barrie

(10) Patent No.: US 7,182,706 B2
(45) Date of Patent: Feb. 27, 2007

(54) BROADHEAD WITH REVERSIBLE OFFSET BLADES

(75) Inventor: Bruce Barrie, Waseca, MN (US)

(73) Assignee: Field Logic Archery, LLC, Superior, WI (US)

( * ) Notice: Subject to any disclaimer, the term of this patent is extended or adjusted under 35 U.S.C. 154(b) by 0 days.

(21) Appl. No.: 11/037,413

(22) Filed: Jan. 18, 2005

(65) Prior Publication Data

US 2005/0159255 A1 Jul. 21, 2005

Related U.S. Application Data

(60) Provisional application No. 60/537,872, filed on Jan. 20, 2004.

(51) Int. Cl.
*F42B 6/08* (2006.01)

(52) U.S. Cl. ..... 473/584

(58) Field of Classification Search ..... 473/578, 473/583, 584

See application file for complete search history.

(56) References Cited

U.S. PATENT DOCUMENTS

| | | | | |
|---|---|---|---|---|
| 4,099,720 | A | 7/1978 | Zeren | |
| 4,210,330 | A | 7/1980 | Kosbab | |
| 4,529,208 | A | 7/1985 | Simo | |
| 4,565,377 | A | 1/1986 | Troncoso et al. | |
| 4,676,512 | A | 6/1987 | Simo | |
| 4,986,550 | A | 1/1991 | Segovia | |
| 5,090,709 | A | 2/1992 | Johnson | |
| 5,257,809 | A | 11/1993 | Carrizosa | |
| D342,303 | S | 12/1993 | Johnson | |
| D370,246 | S | 5/1996 | Johnson | |
| 5,879,252 | A * | 3/1999 | Johnson | 473/583 |
| 5,931,751 | A * | 8/1999 | Cooper | 473/583 |
| 6,015,357 | A | 1/2000 | Rizza | |
| 6,077,180 | A * | 6/2000 | Adams, Jr. | 473/584 |
| 6,319,161 | B1 | 11/2001 | Martinez et al. | |
| 6,554,727 | B1 * | 4/2003 | Armstrong et al. | 473/584 |
| 6,663,518 | B1 | 12/2003 | Kuhn | |
| 2002/0151394 | A1 | 10/2002 | Arasmith | |
| 2003/0236141 | A1 | 12/2003 | Kuhn | |
| 2004/0048704 | A1 | 3/2004 | Arasmith | |
| 2004/0138016 | A1 | 7/2004 | Kuhn | |

OTHER PUBLICATIONS

Bowhunting World, 1989-1990, vol. 38-No. 7, p. 66.

* cited by examiner

*Primary Examiner*—John A. Ricci
(74) *Attorney, Agent, or Firm*—Faegre & Benson LLP

(57) ABSTRACT

A broadhead type arrowhead for coupling to the shaft of an arrow includes a plurality of insertable, removable blades, an elongate body having a tip and a depending body, the tip being designed for penetrating an object at which the arrow is directed, the body having a slot defined therein corresponding to each of the plurality of blades, each slot extending through a portion of the body offset from a broadhead longitudinal axis and having two slot openings, each of the slot openings being common with an adjacent slot; and each of the plurality of blades being selectively insertable in a respective slot from either of the common slot openings to effect a left offset or a right offset as desired. A method of forming such a broadhead is further included.

28 Claims, 8 Drawing Sheets

BROADHEAD WITH REVERSIBLE OFFSET BLADES

RELATED PATENT APPLICATION

The present application claims the benefit of U.S. Provisional Patent Application No. 60/537,872, filed Jan. 20, 2004, which application is incorporated herein by reference in its entirety.

TECHNICAL FIELD

The present application relates to archery equipment. More particularly, the present application relates to an arrowhead of the type known as a broadhead for use with an arrow.

BACKGROUND OF THE INVENTION

As is known, arrows are typically fletched near the trailing edge of the arrow in order to provide stability in flight. The fletching typically comprises feather or plastic vanes that are adhered to the external margin of the arrow shaft. The fletching may be straight or left handed offset or right handed offset. With straight fletching, the plane in which the vane lies intersects the longitudinal axis of the arrow. Such fletching does not induce arrow rotation when in flight. The more preferable type of fletching is either the right handed offset or the left handed offset. In those cases, the plane in which the vane lies is angled with respect to the longitudinal axis of the arrow and cuts the longitudinal axis of the arrow at a single point. Such fletching presents a certain side of the vane to the airstream flowing over the arrow during flight. The airstream generates a greater force on the side of the vane that is presented to the airstream as compared to the opposite side of the vane, i.e., the side of the vane that is not presented to the air stream. This force tends to advantageously rotate the arrow during flight. Such rotation tends to stabilize the arrow in flight. Rotation will be either CW or CCW as a function the fletching being either right handed offset or left handed offset.

At the opposite end of the shaft of the arrow from the fletching is the arrowhead. For use in hunting, the arrowhead may be of the type commonly known as a broadhead. Such broadheads typically have an elongate shank to which is attached between 1 and 5 cutting blades. In most cases, the plane of a particular blade is in alignment with the longitudinal axis of the arrow and coincidentally of the broadhead. In this configuration, the arrangement of the blade or blades likely fights the desired arrow rotation. However, the plane of the blade may also offset or spaced apart from the longitudinal axis of the broadhead. In such cases, the blades may either be offset to the right or to the left and, where matched to the right handed offset or left handed offset fletching, may augment the rotational motion of the arrow that is imparted to the arrow by the fletching during flight.

In the past, an archer had to either obtain a right hand offset broadhead or a left hand offset broadhead to match the specific type of fletching on the arrows used. This was an inconvenience to the providers of broadheads in that they had to produce two different kinds of offset broadheads. This was also an inconvenience to broadhead resellers, as they had to carry double inventory. In addition, the end users were confused as to what broadheads to select to match the fletching on the arrows that they used. There is therefore a need in the industry for a broadhead having an offset blade configuration in which the blades of a single broadhead are interchangeable in order to provide a right hand offset and a left hand offset as desired.

SUMMARY OF THE INVENTION

The present invention substantially meets the aforementioned needs of the industry. The broadhead of the present invention has a plurality of reversible blades that are readily reversed by the archer in order to provide either left hand or right hand offset as desired. In this manner, a single broadhead can provide the desired offset for arrows having either right hand offset fletching or left hand offset fletching. This provides considerable versatility in the hands of the archer in that the single broadhead can be used with either right hand offset fletching or left hand offset fletching if the archer uses arrows of both types. Additionally, the broadhead of the present invention provides significant cost savings to the manufacturer in that only a single offset design meets the needs of all arrows having either right handed offset or left handed offset fletching.

The present invention is a broadhead type arrowhead for coupling to the shaft of an arrow. The broadhead includes a plurality of insertable, removable blades, an elongate body having a tip and a depending body, the tip being designed for penetrating an object at which the arrow is directed, the body having a slot defined therein corresponding to each of the plurality of blades, each slot extending through a portion of the body offset from a broadhead longitudinal axis and having two slot openings, each of the slot openings being common with an adjacent slot; and each of the plurality of blades being insertable in a respective slot from either of the common slot openings to effect a left offset or a right offset as desired. The present invention is further method of forming such a broadhead.

DETAILED DESCRIPTION OF THE DRAWINGS

Figure 1:
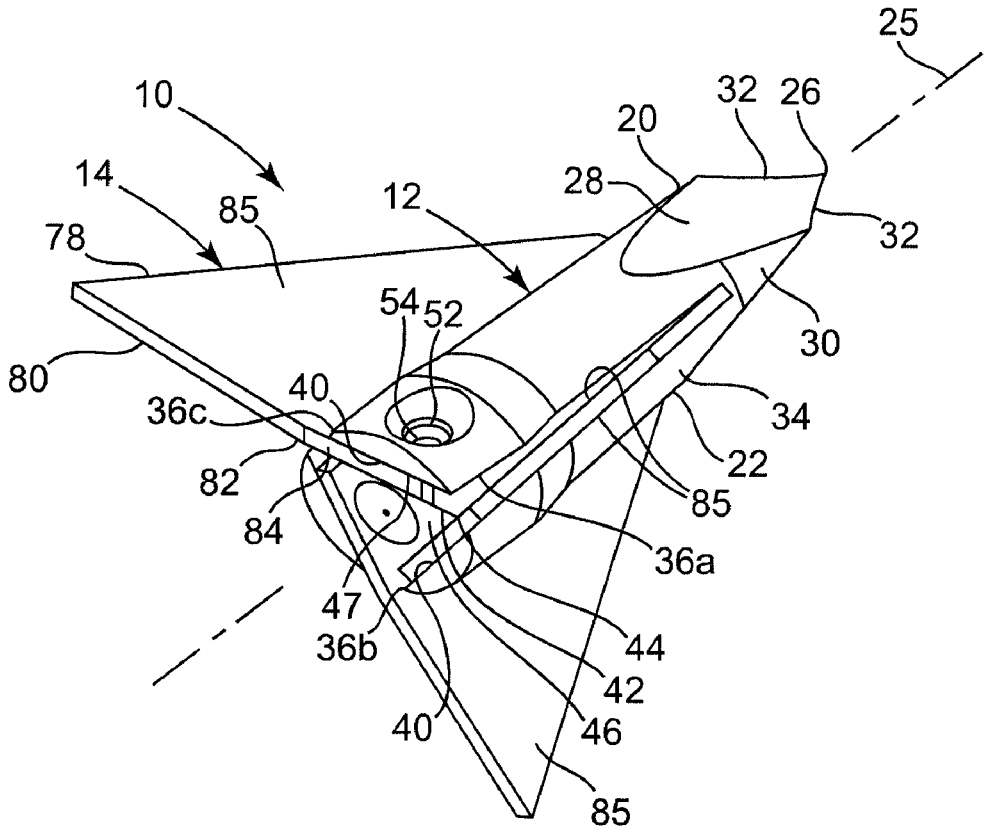
FIG. 1 is a rear perspective view of a first embodiment of the broadhead according to one embodiment of the present invention.

The broadhead of the present invention is shown generally at 10 in the Figures. Each broadhead 10 has two major subcomponents; body 12 and a plurality of blades 14.

Turning first to the body 12 of broadhead 10, as depicted in FIGS. 1–4, the body 12 is preferably a unitary integral device formed of cylindrical metal stock. The body 12 has three major portions; tip 20, shank 22, and threaded end 24. A longitudinal axis 25 extends lengthwise through the center of the body 12, coincidental with an arrow longitudinal axis. The tip 20 has a penetrating point 26. In a preferred embodiment three concave facets 28 extend rearward from the penetrating point 26 and are formed in a cylindrical exterior margin 30 of the tip 20. The concavity of the facets 28 results in the formation of three curved cutting edges 32 at the intersection of adjacent concave facets 28. The curved cutting edges 32 extend reward from the penetrating point 26.

The shank 22 of the body 12 has a generally cylindrical exterior margin 34, having substantially the same diameter as the cylindrical exterior margin 30 of the tip 20. As will be discussed in greater detail below, the exemplary broadheads 10 of FIGS. 1–4 include three equiangularly spaced blades 14. It is understood that a greater or lesser number of blades 14 could be employed with the broadhead 10. In order to accommodate the three blades 14 of the exemplary broadhead 10, there are three common slot openings equal angularly displaced around the cylindrical exterior margin 30 of the shank 22. The common slot openings are indicated at 36*a, b*, and *c*. Each of the common slot openings 36*a, b, c* opens to two adjacent slots, the slots being indicated at 38*a, b*, and such that slot 38*a* opens to both common opening 36*a* and 36*b* and so on. The slots 38*a, b, c* are offset from the longitudinal axis 25. In a first embodiment, (FIG. 1) the slots 38*a, b, c* define a plane that is parallel to and spaced apart from the longitudinal axis 25. In a second preferred embodiment (FIGS. 2–4) the slots 38*a, b, c* are both offset with respect to the longitudinal axis 25 and angled with respect to the longitudinal axis 25. This disposition of the slots 38*a, b, c* is apparent in FIG. 4 where each of the blades 14 is disposed closer to the longitudinal axis 25 at the forward end of respective blades 14 than at the rearward end of the blades 14. Such disposition contributes advantageously to the rotation of the arrow in flight caused by the blades 14 as will be discussed in greater detail below.

Each of the slots 38*a, b, c* are generally rectangular in shape and has a rearward disposed slot base opening 40. The respective slots 38*a, b, c* extend forward from the respective slot base openings 40. Thus, each slot 38*a,b,c* is bounded by three openings and a forward disposed closed edge. The respective slots 38*a, b, c* extend forward from the respective slot base openings 40. The slots 38*a, b, c* have a generally rectangular flat inner margin 42, and opposed spaced apart flat outer margin 47. The flat inner margin 42 of adjacent slots 38*a, b, c* meet at intersections 44 to define a substantially triangular inner shank 46. A transverse bore 52 extends from the exterior margin 34 through to the outer margin 47 of the respective slot 38. A threaded blind bore 54 defined in the inner shank 46 is in registry with the bore 52.

Figure 2:
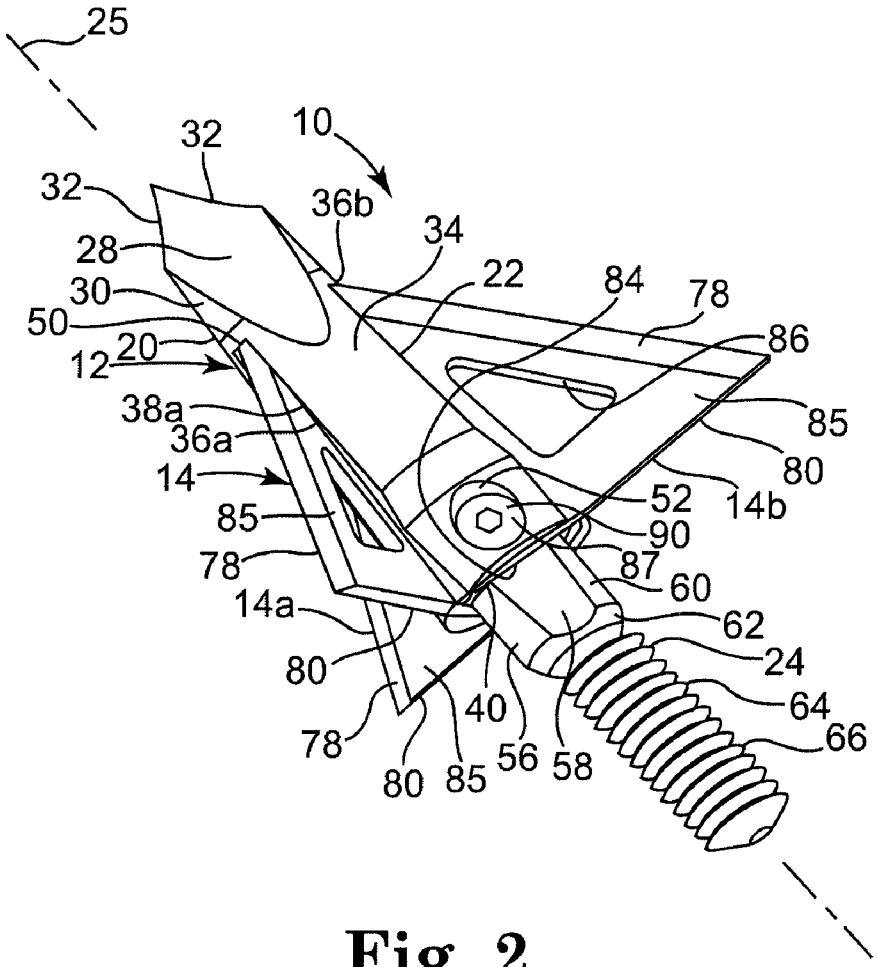
FIG. 2 is a perspective view of a second embodiment of the present invention with the blades in the right offset configuration.
Figure 3:
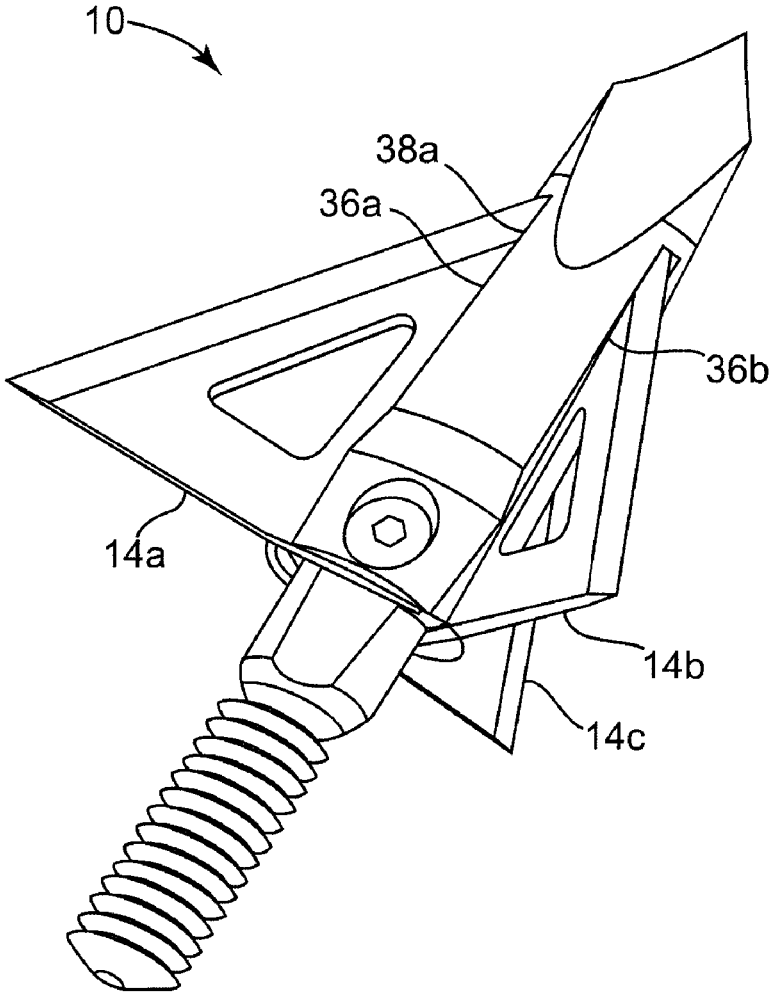
FIG. 3 is a perspective view of the broadhead of FIG. 2 in the left offset configuration.
Figure 4:
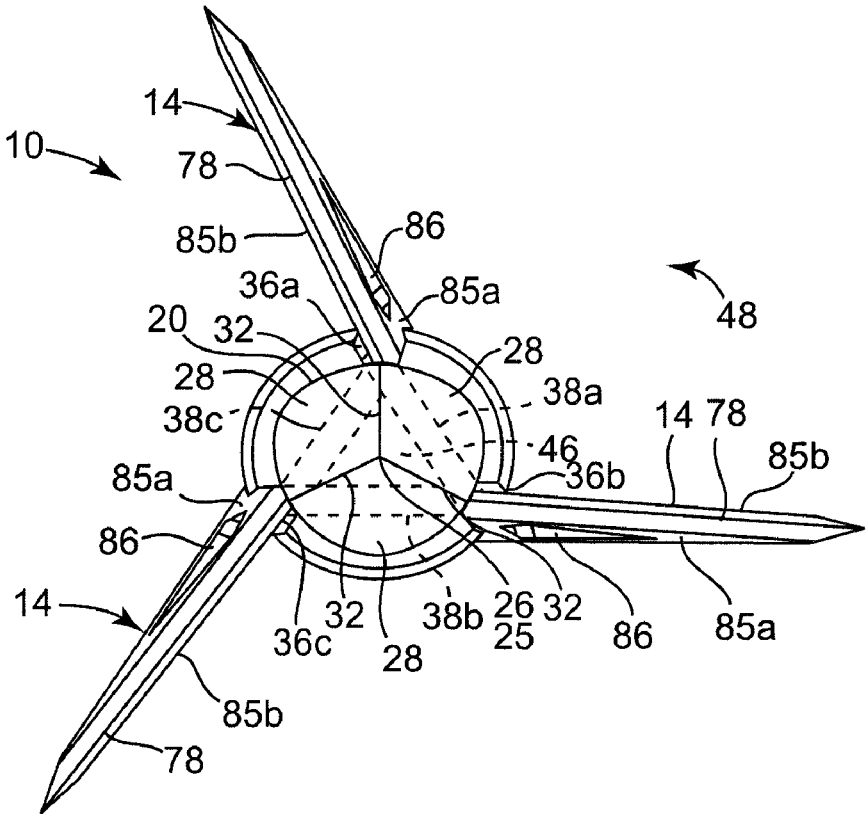
FIG. 4 is a tip-on elevational view of the broadhead of FIG. 2.

It should be noted that the slots 38*a, b, c* of FIG. 1 define a plane that is offset from but parallel to the longitudinal axis 25. The slots 38*a, b, c* of FIGS. 2–4 are also offset from the longitudinal axis 25, but are at an angle with respect to the longitudinal axis 25. The plane defined by the slots 38*a, b, c* of FIGS. 2–4 then intersects the longitudinal axis 25 at a certain point. This angularity is best viewed in the depiction of FIG. 4. In the depiction of FIG. 4, the leading ends of each of the blades 14 (that is, the portion of the blades 14 that is closest to the tip 20) is closer to the longitudinal axis 25 than the trailing edge of each of the blades 14 (that is, the portion of the blades 14 that is closest to the threaded end 24). This angularity results in the side margin 85*a* of each of the blades 14 being presented at an angle to the airstream passing over the arrow in flight, see FIG. 2. The result of such exposure is an aerodynamic force generated on each of the blades 14 that has a resulting vector that is normal to the sides 85*a* and will generally rotate the arrow in the same direction as the fletching of the arrow, as indicated by rotational arrow 48. It should be noted that reversing the blades 14, as is described in greater detail below, will tilt the blades 14 in the opposite direction as the blades 14 are depicted in FIG. 4, resulting in an aerodynamic force acting on the side margin 85*b* of the blades 14. The resulting aerodynamic force will generally rotate the arrow in the opposite direction, as indicated by the rotational arrow 48. See FIG. 3 for the reversed blades as noted above.

As noted above, each of the slots 38*a, b, c* is bounded by an adjacent two of the common slot openings 36*a, b, c* by a slot base opening 40, and by a transverse forward edge 50 that is defined substantially transverse to the common slot openings 38*a, b, c*. The transverse forward edge 50 is not an opening.

Referring to FIGS. 2 and 3, the shank 22 of the body 12 further includes a rear shank end 56. The rear shank end 56 of a preferred embodiment has three equiangularly spaced faces 58 that are joined by curved intersections 60. A taper 62 extends from the shank 22 to the threaded end 24. The threaded end 24 has a cylindrical end member 64 and a plurality of threads 66 formed thereon. The threads 66 are designed to threadedly engage cooperative threads formed in a longitudinal bore defined in the shaft of the arrow or in an insert disposed in the shaft of the arrow.

Figure 5:
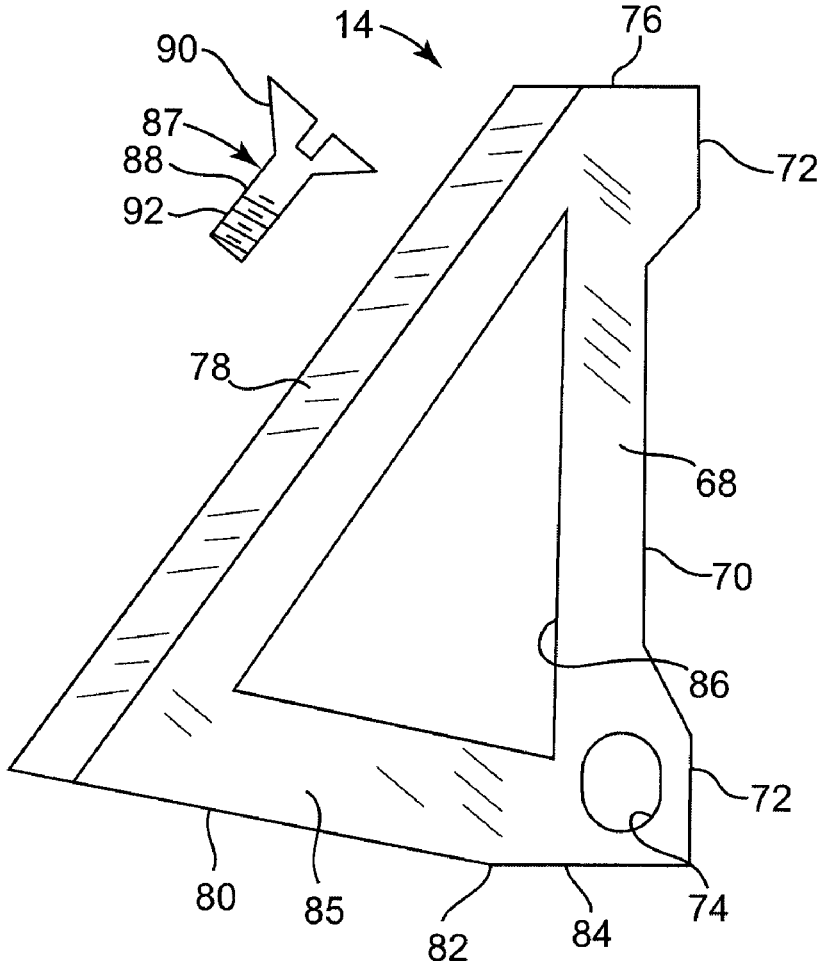
FIG. 5 is an elevational view of a blade utilized with the broadhead of FIG. 2.
Figure 6:
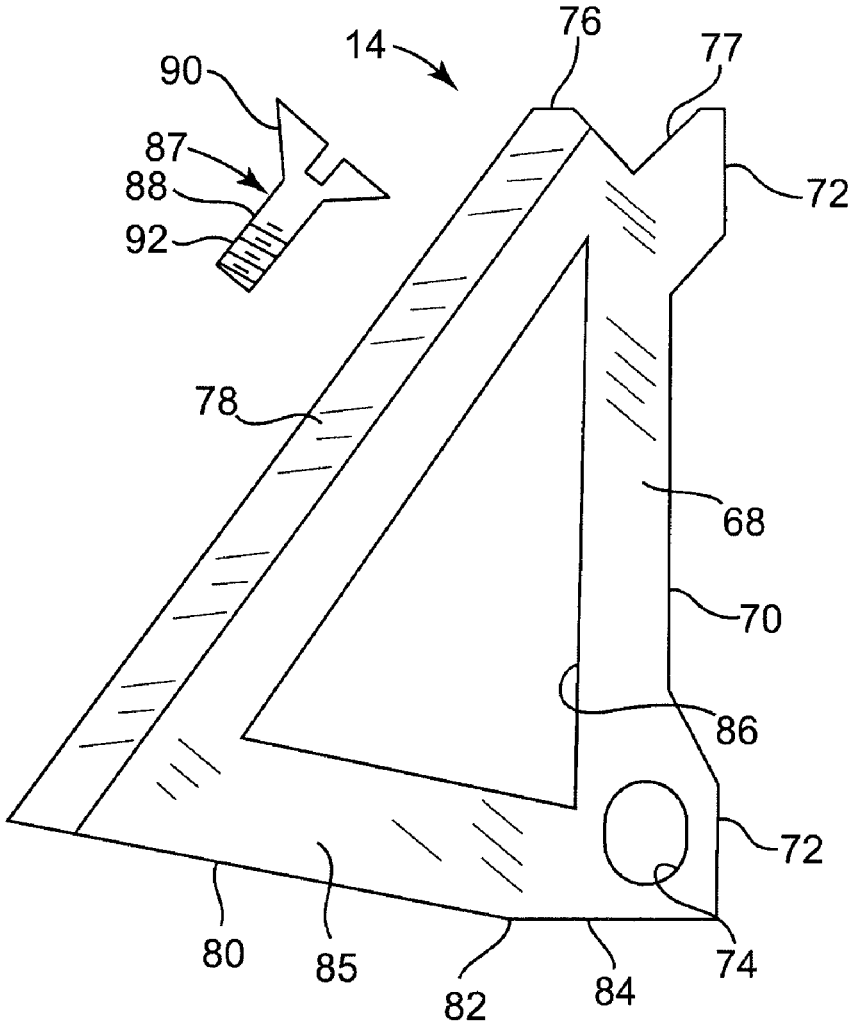
FIG. 6 is an elevational view of a blade utilized with the broadhead of FIG. 2.

A preferred blade 14 and coupler 87 are depicted in FIG. 5. The blade 14 is preferably made from a single thin sheet of metallic material, such as steel or stainless steel. The blade 14 has an elongate base side 68. The base side 68 has an elongate notch 70 that is defined between base edges 72. The two base edges 72 lie along a co-linear line. A bore 74 is defined transverse to the blade 14 proximate the rear or trailing edge of the blade 14. The bore 74 may be oval as depicted in FIG. 5. A forward flat 76 extends generally transverse to the co-linear base edges 72. In another embodiment of the present invention, the forward flat 76 comprises a notch 77 having a desired shape or configuration, such as a "V" notch 77 as depicted in FIG. 6. In this embodiment, it is preferable that the notch 77 on the forward flat 76 be generally symmetrical. It is also preferable that the notch 77 match the shape of the body slot 38. A cutting edge 78 is defined at an angle to the forward flat 76 and extends to the blunt rear edge 80 of the blade 14. The rear edge 80 is connected at a step 82 to a rear flat 84 of the blade 14. Each of the blades 14 has two opposing side margins 85 (85*a, b* in some of the depictions to aid in describing the right and left handedness of the reversible blades 14), one of which is depicted in FIG. 5. A generally triangular lightening cutout or aperture 86 may be defined in the blade 14. In additional embodiments of the present invention, different shapes or configurations of the cutout 86 may be used without departing from the spirit and scope of the present invention. Alternatively, in another embodiment of the present invention, the blade 14 does not include a cutout 86.

The coupler 87 for fixably coupling the blade 14 to the body 12 may be a slotted screw 88 having a head 90 and a threaded shank 92. As depicted in FIGS. 2 and 3, the coupler 87 may have a hexagonal indent in the head 90 for turning the coupler 87 into the threaded blind bore 54 defined in the shank 22.

In assembly, a blade 14 is slid through a common slot opening 36 into a slot 38. The forward flat 76 abuts the transverse forward edge 50 of the respective slot 38. The base edges 72 of the blade 14 abut (are flush with) the second of the two adjacent common slot openings 36 that opens into the particular slot 38, but do not project into the slot opening 36. The rear flat 84 is preferably flush with the slot base opening 40 of the slot 38. In the above described disposition, the coupler 87 may be passed through the transverse bore 52 defined in the shank 22, through the bore 74 defined in the blade 14, and threadedly engaged with the threaded blind bore 54 defined in the triangular inner shank 46. In this manner, the blade 14 is rigidly held in place within the respective slot 38 and is thereby rigidly joined to the body 12 of the broadhead 10 and thusly repeatedly withstands the impact of the broadhead 10 with an intended object.

FIGS. 2 and 3 depict the reversible nature of the offset blades of the present invention. In both FIGS. 2 and 3, the slot 38*a* is depicted extending between the common slot openings 36*a* and 36*b*. In the depiction of FIG. 2, the blade designated as 14*b* resides in the slot 38*a* and extends rightward therefrom to define the right offset configuration of the broadhead 10. In the depiction of FIG. 3, the blade 14*a* residing in the slot 38*a* extends leftward from the common slot opening 36*a* and the slot 38*a*. This defines the left offset configuration of the broadhead 10. This can be seen in comparing the depictions of FIGS. 2 and 3. The blade 14*a* is exactly oppositely disposed with respect to the slot 38*a*. In the depiction of FIG. 2, the blade 14*b* projects rightward from the opening 36*b*. In the depiction of FIG. 3, the blade 14*a* projects leftward from the common slot opening 36*a*. This reversing of the blades 14 may be simply effected by merely removing the coupler 87 and reversing the blade 14 in the respective slot 38 and reinserting the couple 87 to affix the blade 14 to the body 12 in the opposite orientation to achieve either the desired right or left handedness of the offset blades 14.

Figure 7:
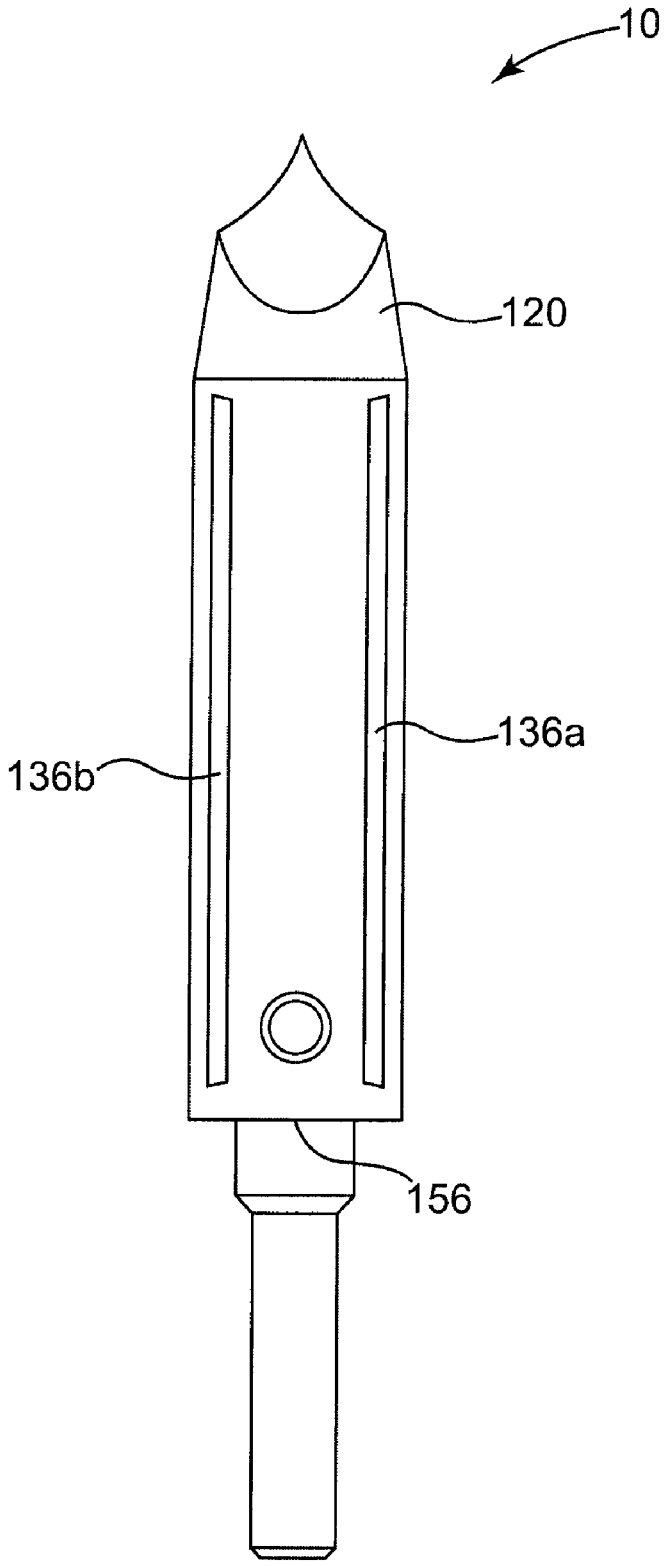
FIG. 7 is an elevational view of a broadhead body according to an embodiment of the present invention.
Figure 8:
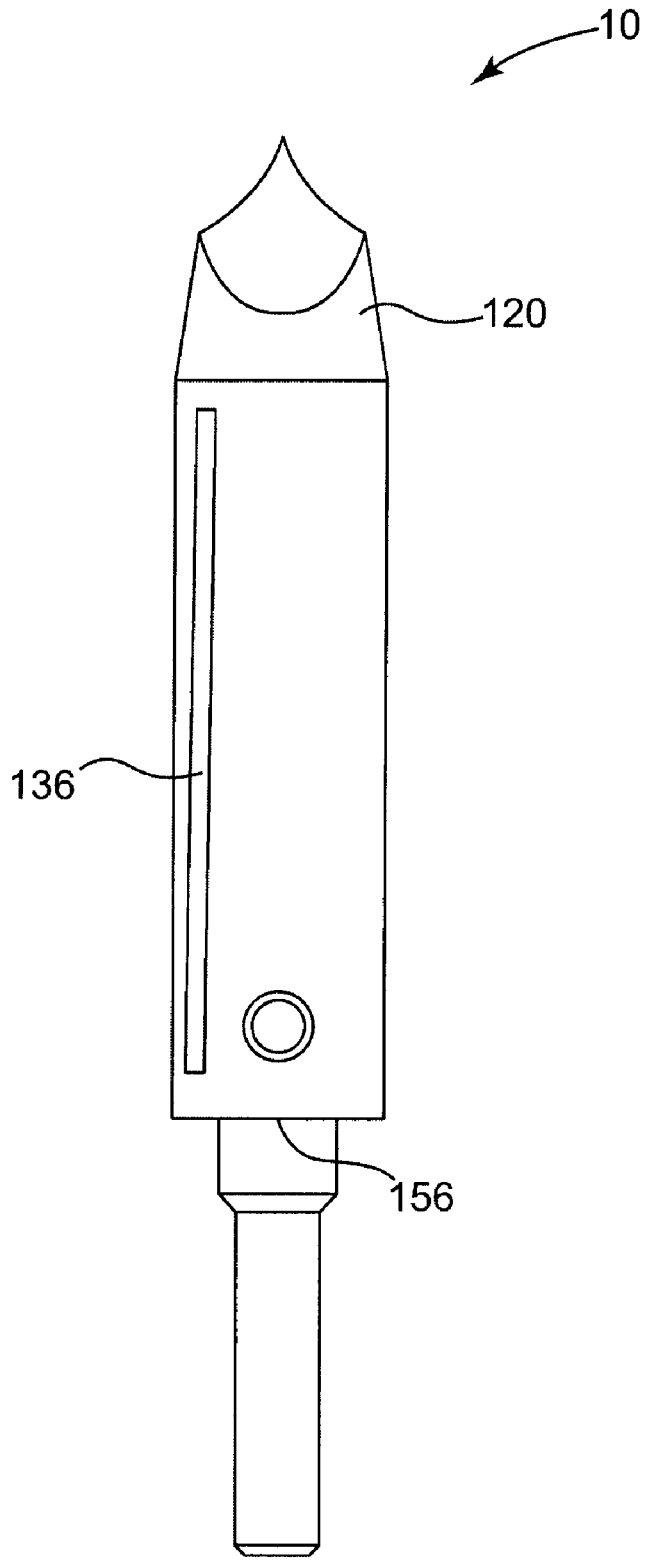
FIG. 8 is an elevation view of a broadhead body according to an embodiment of the present invention.

In another embodiment of the present invention, as depicted in FIG. 7, the blade openings 136*a*, 136*b*, 136*c* on the shank 22 on the body 12 are plunged slots, the blade openings 136*a*, 136*b*, 136*c* being open on two sides and closed on ends proximate a tip 120 and proximate a rear shank end 156. Blade openings 136*a*, 136*b*, 136*c* are preferably made using laser cutting, although they could be made using other methods, including wire cutting. Blade openings 136*a*, 136*b*, 136*c* are generally different than blade openings 36*a*, 36*b*, 36*c* described above, as blade openings 36*a*, 36*b*, 36*c*, as depicted in FIGS. 1–3, are generally open on two sides and proximate the rear shank end 56 and closed at and end proximate the tip 20. FIG. 8 depicts a plunged slot blade opening 136 on the shank 22, wherein the plunged slot is offset.

It will be obvious to those skilled in the art that other embodiment in addition to the one that is described herein are indicated to be within the scope of breath of the present application. Accordingly, the Applicant tends to be limited only by the claims appended hereto.

What is claimed is:

1. A broadhead type arrowhead for coupling to the shaft of an arrow, the broadhead comprising:

a plurality of insertable, removable blades;

an elongate body having a tip and a depending body, the tip being designed for penetrating an object at which the arrow is directed, the body having a slot defined therein corresponding to each of the plurality of blades, each slot extending through a portion of the body offset from a broadhead longitudinal axis and having two slot openings, each of the slot openings being common with an adjacent slot; and each of the plurality of blades being selectively insertable in a respective slot from either of the common slot openings to effect a left offset or a right offset as desired.

2. The broadhead of claim 1 wherein the respective slots are offset from the longitudinal axis and parallel to the longitudinal axis.

3. The broadhead of claim 1 wherein the respective slots are offset from the longitudinal axis and angled with respect to the longitudinal axis.

4. The broadhead of claim 1 wherein the respective slots are offset from the longitudinal axis and angled inward with respect to the longitudinal axis such that the slot is closer to the longitudinal axis at a slot leading portion, the slot leading portion being closest to the tip, than a slot rearward portion, the slot rearward portion being disposed furthest from the tip.

5. The broadhead of claim 1 wherein the respective blades, when disposed in respective slots in a first disposition are angled with the respect to the longitudinal axis such that a certain first blade side is presented to an airstream flowing past the arrow in flight.

6. The broadhead of claim 5 wherein the respective blades, when in a reverse second disposition in respective slots are angled with the respect to the longitudinal axis such that a certain second blade side is presented to an airstream flowing past the arrow in flight.

7. The broadhead of claim 5 wherein the respective blades, when in a reverse second disposition in respective slots are reverse angled with the respect to the longitudinal axis.

8. The broadhead of claim 5 wherein the respective blades, when in a reverse second disposition in respective slots are angled with the respect to the longitudinal axis such that a certain second blade side is presented to an airstream flowing past the arrow in flight, an aerodynamic force being developed thereby on the certain second blade side acting to rotate the arrow in a second direction.

9. The broadhead of claim 1 wherein the respective blades may be selectively disposed in respective slots to project from either a first common slot opening or an opposed second common slot opening of a certain slot to effect the left offset or the right offset as desired.

10. The broadhead of claim 1 wherein the respective blades, when disposed in respective slots in a first disposition are angled with the respect to the longitudinal axis such that a certain first blade side is presented to an airstream flowing past the arrow in flight, an aerodynamic force being thereby developed on the certain first blade side acting to rotate the arrow in a first direction.

11. The broadhead of claim 1, the body being formed of unitary, integral construction.

12. The broadhead of claim 1, the body being distinct from the tip.

13. The broadhead of claim 1, the blades being generally triangular in shape and having a lightening blade aperture defined therein.

14. The broadhead of claim 1, the blade slot being triangular in shape.

15. The broadhead of claim 1, the blades being retained at least in part in the slots by a respective removable coupler.

16. The broadhead of claim 15, wherein the coupler comprises a screw that is passed through a bore defined in the blade and is threadedly engaged with a threaded bore defined in the body.

17. The broadhead of claim 1, wherein there are at least three blades.

18. A method of forming a broadhead type arrowhead, the broadhead for coupling to the shaft of an arrow, the method comprising:

providing a plurality of insertable, removable blades;

providing an elongate body having a tip and a depending body, designing the tip for penetrating an object at which the arrow is directed, defining a slot in the body corresponding to each of the plurality of blades, defining each slot extending through a portion of the body offset from a broadhead longitudinal axis and having two slot openings and forming each of the slot openings common to an adjacent slot; and inserting each of the plurality of blades in a respective slot from either of the common slot openings to effect a left offset or a right offset as desired.

19. The method of claim 18 including offsetting the respective slots from the longitudinal axis in a plane that is parallel to the longitudinal axis.

20. The method of claim 18 including offsetting the respective slots from the longitudinal axis and angling the respective slots with respect to the longitudinal axis.

21. The method of claim 18 including offsetting the respective slots from the longitudinal axis and angling the respective slots inward with respect to the longitudinal axis such that each slot is closer to the longitudinal axis at a slot leading portion, the leading portion being closest to the tip, than a slot rearward portion, the slot rearward portion being disposed furthest from the tip.

22. The method of claim 18 including disposing the respective blades in respective slots in a first angled disposition with the respect to the longitudinal axis such that a certain first blade side is presented to an airstream flowing past the arrow in flight.

23. The method of claim 22 including reversing the respective blades in a reverse second disposition in respective slots and thereby reverse angling the blades with the respect to the longitudinal axis such that a certain second blade side is presented to an airstream flowing past the arrow in flight.

24. The method of claim 22 including reversing the respective blades in a reverse second disposition in respective slots to effect reverse angling the blades with the respect to the longitudinal axis.

25. The method of claim 22 including reversely disposing the respective blades in a reverse second disposition in the respective slots at an angle with the respect to the longitudinal axis such that a certain second blade side is presented to an airstream flowing past the arrow in flight and rotating the arrow in a second direction by means of an aerodynamic force developed thereby on the certain second blade side.

26. The method of claim 18 including selectively disposing the respective blades in respective slots to project from either a first common slot opening or an opposed second common slot opening of a certain slot to effect the left offset or the right offset as desired.

27. The method of claim 18 including disposing the respective blades in a first disposition in respective slots at an angle with the respect to the longitudinal axis such that a certain first blade side is presented to an airstream flowing past the arrow in flight and rotating the arrow in a first direction by means of an aerodynamic force developed on the certain first blade side.

28. The method of claim 18, wherein each blade is retained at least in part within the respective slot.

* * * * *